US011680758B2

(12) United States Patent
Borchert

(10) Patent No.: US 11,680,758 B2
(45) Date of Patent: Jun. 20, 2023

(54) BREECH SYSTEM AND BARRELLED WEAPON

(71) Applicant: Rheinmetall Waffe Munition GmbH, Suedheide (DE)

(72) Inventor: Ruediger Borchert, Hermannsburg (DE)

(73) Assignee: Rheinmetall Waffe Munition GmbH, Suedheide (DE)

( * ) Notice: Subject to any disclaimer, the term of this patent is extended or adjusted under 35 U.S.C. 154(b) by 0 days.

(21) Appl. No.: 17/675,141

(22) Filed: Feb. 18, 2022

(65) Prior Publication Data

US 2022/0170707 A1 Jun. 2, 2022

Related U.S. Application Data

(63) Continuation of application No. PCT/EP2020/070777, filed on Jul. 23, 2020.

(30) Foreign Application Priority Data

Aug. 20, 2019 (DE) ..... 10 2019 122 290.7

(51) Int. Cl.
*F41A 3/10* (2006.01)

(52) U.S. Cl.
CPC ..... *F41A 3/10* (2013.01)

(58) Field of Classification Search
CPC ..... F41A 3/10; F41A 17/42
(Continued)

(56) References Cited

U.S. PATENT DOCUMENTS 2,434,972 A * 1/1948 Vick ..... F41A 15/10 89/24
3,362,292 A * 1/1968 D'Andrea ..... F41A 5/32 89/24

(Continued)

FOREIGN PATENT DOCUMENTS

DE 3914538 A1 11/1990
DE 3839496 C2 1/1992

(Continued)

OTHER PUBLICATIONS

International Search Report dated Nov. 2, 2020 in corresponding application PCT/EP2020/070777.

(Continued)

*Primary Examiner* — Bret Hayes
(74) *Attorney, Agent, or Firm* — Muncy, Geissler, Olds & Lowe, P.C.

(57) ABSTRACT

A breech system having a weapon barrel which is mounted in a cradle such that it can be moved from a rest position to a recoil position, said breech system comprising a base piece, comprising a breech wedge which can be moved between a closed and open position, a breech mechanism which is attached to the base piece and a guide piece which is fixed to the cradle and has a guide element, wherein the guide element has an actuating element for actuating the breech mechanism, wherein the breech mechanism has a lever mechanism that can be actuated by the actuating element, wherein the breech mechanism has a locking lever which is coupled to the lever mechanism, and wherein the breech wedge can be locked in the open position by the locking lever.

15 Claims, 14 Drawing Sheets

(58) Field of Classification Search
USPC ..... 89/24
See application file for complete search history.

(56) References Cited

U.S. PATENT DOCUMENTS

| | | | | |
|---|---|---|---|---|
| 4,462,299 | A * | 7/1984 | Grunewald | F41A 5/32 89/24 |
| 4,986,162 | A | 1/1991 | Wissing | |
| 5,589,656 | A * | 12/1996 | Tortorici, Jr. | F41A 3/10 89/24 |
| 6,006,645 | A * | 12/1999 | Breuer | F41A 3/10 89/24 |
| 6,186,041 | B1 | 2/2001 | Menges | |
| 6,595,100 | B2 | 7/2003 | Breuer et al. | |
| 8,857,308 | B1 * | 10/2014 | Kurowsky | F41A 3/10 89/24 |
| 2003/0051600 | A1 * | 3/2003 | Breuer | F41A 5/02 89/37.14 |

FOREIGN PATENT DOCUMENTS

| | | | |
|---|---|---|---|
| DE | 19804653 | A1 | 8/1999 |
| DE | 19823785 | A1 | 12/1999 |
| DE | 10146423 | A1 | 4/2003 |
| DE | 102004052550 | A1 | 5/2006 |
| DE | 102009037899 | A1 | 2/2011 |
| DE | 102010015570 | B3 | 6/2011 |
| DE | 102010015569 | A1 | 10/2011 |
| RU | 2678934 | C1 | 2/2019 |

OTHER PUBLICATIONS

Written Opinion of the International Searching Authority dated Nov. 2, 2020 in corresponding application PCT/EP2020/070777.

* cited by examiner

BREECH SYSTEM AND BARRELLED WEAPON

This nonprovisional application is a continuation of International Application No. PCT/EP2020/070777, which was filed on Jul. 23, 2020, and which claims priority to German Patent Application No. 10 2019 122 290.7, which was filed in Germany on Aug. 20, 2019, and which are both herein incorporated by reference.

BACKGROUND OF THE INVENTION

Field of the Invention

The present invention relates to a breech system for a weapon barrel mounted such that it can be moved from a rest position to a recoil position, said breech system comprising a base piece, a breech wedge which can be moved between a closed and open position, in particular transversely to the barrel bore axis of the weapon barrel, a breech mechanism which is attached to the base piece, and a guide piece which is fixed to the cradle and has a guide element, wherein the guide element has an actuating element for actuating the breech mechanism, wherein the breech mechanism has a lever mechanism that can be actuated by the actuating element.

Description of the Background Art

A wedge breechblock is known from DE 10 2004 052 550 A1, which is incorporated herein by reference, for a barrelled weapon. The wedge breechblock has a breech wedge which can be opened downwards perpendicular to the bore axis of the weapon barrel.

DE 198 04 653 A1, which corresponds to U.S. Pat. No. 6,186,041, which is incorporated herein by reference, discloses a weapon barrel breechblock for a large-caliber barrelled weapon with a wedge breechblock, which opens and closes the breech exclusively by an external drive, so that no impact loads occur.

DE 198 23 785 A1, which is incorporated herein by reference, discloses a vertical wedge breechblock for a large-caliber barrelled weapon, which can be opened and closed driven externally by means of an external drive that is fixed to the cradle and by an opener lever that is fixed to the cradle.

DE 10 2009 037 899 A1, which is incorporated herein by reference, discloses a wedge breechblock for a barrelled weapon with a base piece connected to the weapon barrel at the rear. The wedge breechblock has multiple blocking elements that hold the breech wedge in an open position when the weapon is loaded. In this regard, the breech wedge remains in its open position for as long as a rammer for loading a cartridge keeps the blocking elements in a position blocking the wedge breechblock.

DE 10 2010 015 570 A1 and DE 101 46 423 A1, which corresponds to US 2003/0051600, and which are each herein incorporated by reference, and in which each disclose a barrelled weapon with a barrel closure that has a wedge breechblock. The wedge breechblock has a base piece and a breech wedge that can be opened and closed via a breech mechanism. A spring-loaded control unit with movable elements is arranged on the cradle, which elements actuate the breech mechanism on the base piece when, after a shot has been fired, the base piece has advanced so far that these elements come into contact.

DE 10 2010 015569 A1, which is incorporated herein by reference, relates to a barrelled weapon with a wedge breechblock. A breech mechanism, via which the wedge breechblock can be opened and closed, is disposed on the base piece of the wedge breechblock. A guide element is arranged on the cradle of the barrelled weapon in a cradle-fixed manner, via which guide element a lever of the breech mechanism can be actuated in order to open and close the breech. If the wedge breechblock is to remain closed after the shot has been fired, the guide element must be swiveled away manually.

The already known weapon barrel closures have an opener lever or a closing lever for the manual opening and closing apart from a shot being fired; these are to be actuated separately.

In addition, intermediate positions of the breech wedge between the completely open and closed position are not possible with conventional weapon barrel closures. This has the result that externally driven closures can only be opened when they are fully advanced, so that smoke evacuators cannot exert an optimal effect.

SUMMARY OF THE INVENTION

It is therefore an object of the present invention to provide a breech system that locks automatically in the open position.

According to the invention, a breech system is provided for a weapon barrel which is mounted in particular in a cradle such that it can be moved from a rest position to a recoil position; a breech system is provided for a barrelled weapon, in particular with a weapon barrel which is mounted in a cradle such that it can be moved from a rest position to a recoil position, said breech system comprising a base piece with a breech wedge which can be moved between a closed and open position, in particular transversely to the barrel bore axis of the weapon barrel, a breech mechanism which is attached to the base piece, and a guide piece which is fixed to the cradle and has a guide element, wherein the guide element has an actuating element for actuating the breech mechanism, wherein the breech mechanism has a lever mechanism that can be actuated by the actuating element.

The breech mechanism has a locking lever which is coupled to the lever mechanism, wherein the breech wedge can be locked in its open position by the locking lever.

Further, according to the invention, a barrelled weapon with a cradle and a weapon barrel, mounted in the cradle such that it can be moved from a rest position to a recoil position, is provided and comprises at least one such breech system or one as developed further below.

The breech wedge is thus held by the breech mechanism. The loading of the weapon and the closing of the breech can thus be decoupled. The breech wedge can thus be kept open independently of the loading and unloading.

It is achieved due to the fact that the breech wedge is locked in its open position that the closing of the breech wedge is decoupled from the advance of the base piece and the breech mechanism situated thereon. It is achieved hereby that the breech wedge after opening is locked in the open position by the breech mechanism with the locking lever.

The actuation of the breech, in particular the opening of the breech, is carried out by the actuating element which is secured to the cradle. With continuous firing, the breech is opened by the actuating element and simultaneously actuated by the lever mechanism such that the breech can be locked in its open position by the locking lever.

By using the forward movement, an early and quick opening of the breech wedge is possible.

The breech system can be a weapon barrel breech.

The breech mechanism can have a detent pawl which interacts with the locking lever and can be unlocked by the locking lever via an unlocking mechanism coupled to the detent pawl.

This makes it possible to enable unlocking of the wedge independently of the forward position of the base piece. The unlocking can be realized independently of the position of the recoiling mass of the weapon, therefore, the base piece and weapon barrel. This ensures that the breech remains open during the actual loading process of the cartridge until the loading process is completely finished. The breech wedge is not closed again until the unlocking mechanism has been actuated.

This has a positive effect, in particular with regard to barrelled weapons with an automatic loader, because a part of the automatic loader can now actuate the unlocking and thus the closing of the breech wedge.

In addition, a smoke evacuator arranged on the weapon barrel achieves an improved effect as a result.

The unlocking mechanism can be connected to an unlocking cam disposed in the base piece opening.

Preferably, the unlocking cam can be actuated by a part of the automatic loader, such as a cartridge loading head, a loading tray, or a ram head.

It is achieved hereby that the unlocking mechanism can be actuated independently of the loading process by a part of the automatic loader, such as a cartridge loading head, a loading tray, or a ram head. The unlocking mechanism is not unlocked immediately after loading the cartridge, but only after a part of the automatic loader has been removed from the breech. The breech wedge is not closed again until the part of the automatic loader retracts after the actual loading process and the unlocking cam is actuated, as a result of which the unlocking mechanism is actuated and this unlocks the locking lever from the detent pawl. For this purpose, the locking lever is preferably rotated so that it is decoupled from the locking lever by the detent pawl.

The unlocking can also occur during the loading process in the forward/loading movement of the cartridge loading head.

The unlocking can occur further using the ejector lever if its forward movement during the loading process actuates the locking lever or the detent pawl by means of a lever, so that the locking lever is decoupled from the detent pawl and closes the breech wedge.

The breech wedge can be caught in the open position, for which purpose the locking lever is rotated by a return spring via the detent pawl and is thus blocked.

The lever mechanism can comprise a folding lever which interacts with the actuating element such that the lever mechanism can be actuated by the actuating element in an actuation direction and the folding lever can be folded away in a direction opposite to the actuation direction.

To this end, the folding lever interacts with the actuating element.

It is achieved hereby that the actuating cam actuates the lever mechanism when the weapon advances, so that the breech wedge can be moved into its open position and can be locked in this open position. On the other hand, during weapon recoil, the folding closure folds away so that actuation of the lever mechanism is prevented.

The base piece can comprise a bearing in which the guide piece, fixed to the cradle, is mounted so as to be axially movable.

This achieves an axially movable mounting of the base piece relative to the cradle. The guide piece, fixed to the cradle, has the function of preventing rotation between the base piece and cradle, so that the base piece cannot rotate relative to the cradle, but can still be moved axially.

The breech mechanism can have a toothed rack and the lever mechanism comprises a toggle lever, wherein the toggle lever comprises a coupler, a toggle joint, and a lever, wherein one end of the lever is coupled to the toothed rack and one end of the lever is coupled to the locking lever via the toggle joint of the toggle lever.

The breech mechanism can have an opener shaft with a gear wheel, wherein the gear wheel is in engagement with the toothed rack. The gear wheel is nonrotatably disposed on the opener shaft.

The opener shaft can have an opener lever which interacts with the breech wedge such that the breech wedge can be moved between a closed and open position by the opener lever.

The opener lever is fixedly connected to the opener shaft, so that the breech wedge can be moved in its position by turning the opener shaft.

The actuating element can be designed such that it interacts with the lever mechanism when the barrelled weapon advances such that the breech wedge can be moved between the closed and open position by it, in particular in interaction with at least the toothed rack, the gear wheel, the opener shaft, and the opener lever.

The toothed rack can be connected to a wedge closing spring, which is disposed in particular in the toothed rack and by means of which the breech wedge can be pretensioned in the open position in the direction of its closed position.

The closing wedge spring slows down the breech wedge when it is moved from the closed to the open position and stores energy in the open position. When the wedge is unlocked, the wedge closing spring provides the energy for moving the wedge from the open position to the closed position.

In addition, it can be provided that the breech system has a drive, in particular a linear drive, which is set up to realize an axial movement between the drive and the guide element, so that the actuating element can be moved in its position relative to the lever mechanism by the drive.

This makes it possible to actuate the breech mechanism such that the breech wedge can be moved between the closed and open position independently of the weapon advance or recoil.

The breech wedge of the breech system can be opened and closed in its rest position by the drive. Further, the breech wedge can be positioned by the drive in intermediate positions between the closed and open position. These intermediate positions can be approached without any safety problems resulting.

An improved smoke evacuation by the smoke evacuator can be ensured in this way.

The drive and actuating element can be such that they decouple automatically as soon as the breech wedge is opened due to a shot being fired. The breech actuation by the drive is thus decoupled from the forward motion of the recoiling mass.

Thus, unwanted intermediate positions of the drive and the actuating element do not lead to dangerous operating conditions or to damage to the breech actuation.

It is advantageous further that only one drive is designed for the opening and closing functions. In addition, the function of keeping the breech closed after firing can be realized. All essential functions for actuating the breech wedge can be realized by one drive, such as opening in the advancing position, closing and opening on demand, and/or maintaining the closed position after firing.

Furthermore, the drive can be designed such that the breech wedge can both be opened by the actuating cam and opened and/or closed by the drive.

The actuating cam can preferably be spring-loaded and/or damped with regard to the drive. A spring and/or a damper can be formed here at the appropriate position. Further, a pretensioned spring is preferably formed.

As a result, maximum forces can be reduced and correspondingly weaker commercially available drives can also be used.

The guide element can be designed as a guide carriage that is attached axially movable to the guide element, wherein the guide carriage is mounted to be axially movable along the guide rail.

In this case, the actuation takes place using the guide carriage, which is mounted on the guide profile so as to be linearly movable. The position of the guide carriage is determined by the drive. The transmittable force is limited in this case with the help of a storage spring. The actuating cam, with which the lifting mechanism is actuated, is disposed on the guide carriage.

It can be provided further that the guide element is designed as a guide profile with the actuating element, wherein the guide profile is movably mounted directly on the base piece.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus, are not limitive of the present invention, and wherein.

DETAILED DESCRIPTION

Figure 1:
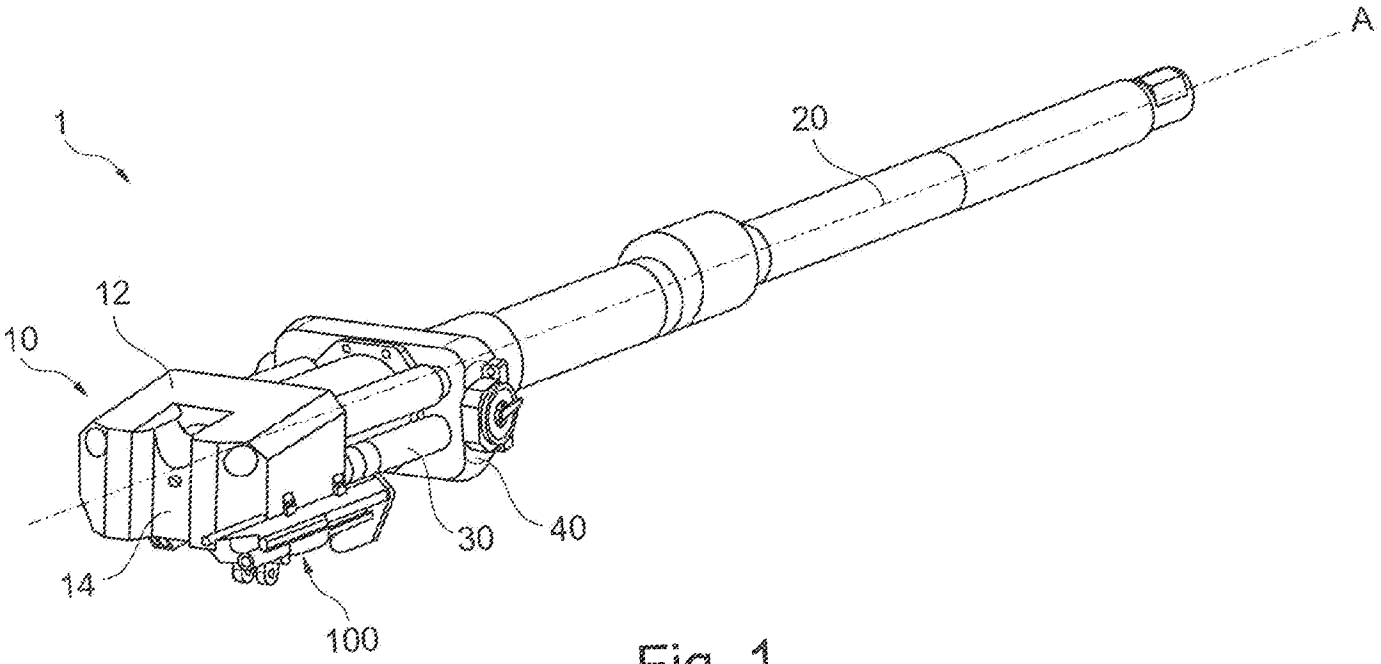
FIG. 1 shows a schematic perspective view of a barrelled weapon with a breech system of the invention.

FIG. 1 shows a schematic perspective view of a barrelled weapon 1 with a breech system 10 of the invention according to an exemplary embodiment.

In addition to breech system 10, barrelled weapon 1 comprises a cradle 40 and a weapon barrel 20 which is movably mounted in cradle 40. Weapon barrel 20 is mounted in cradle 40 so as to be movable between a rest position and a recoil position. Breech system 10, which has a base piece 12, is disposed at the end of weapon barrel 20. Muzzle brakes 30 and recuperators are formed between base piece 12 and cradle 40.

Breech system 10 is thus provided for weapon barrel 20 which is mounted in cradle 40 so as to be movable from a rest position to a recoil position.

Breech system 10 comprises base piece 12, comprising a breech wedge 14 that can be moved between a closed and open position, a breech mechanism 100 attached to base piece 12, and a guide piece 105 which is fixed to the cradle and has a guide element 110.

As can be seen clearly in FIG. 8 and is described in detail below, guide element 110 has an actuating element 114 for actuating breech mechanism 100. Breech mechanism 100 further comprises a lever mechanism 150 that can be actuated by actuating element 114. Further, breech mechanism 100 comprises a locking lever 161 coupled to lever mechanism 150, wherein breech wedge 14 can be locked in the open position by locking lever 161.

Figure 2:
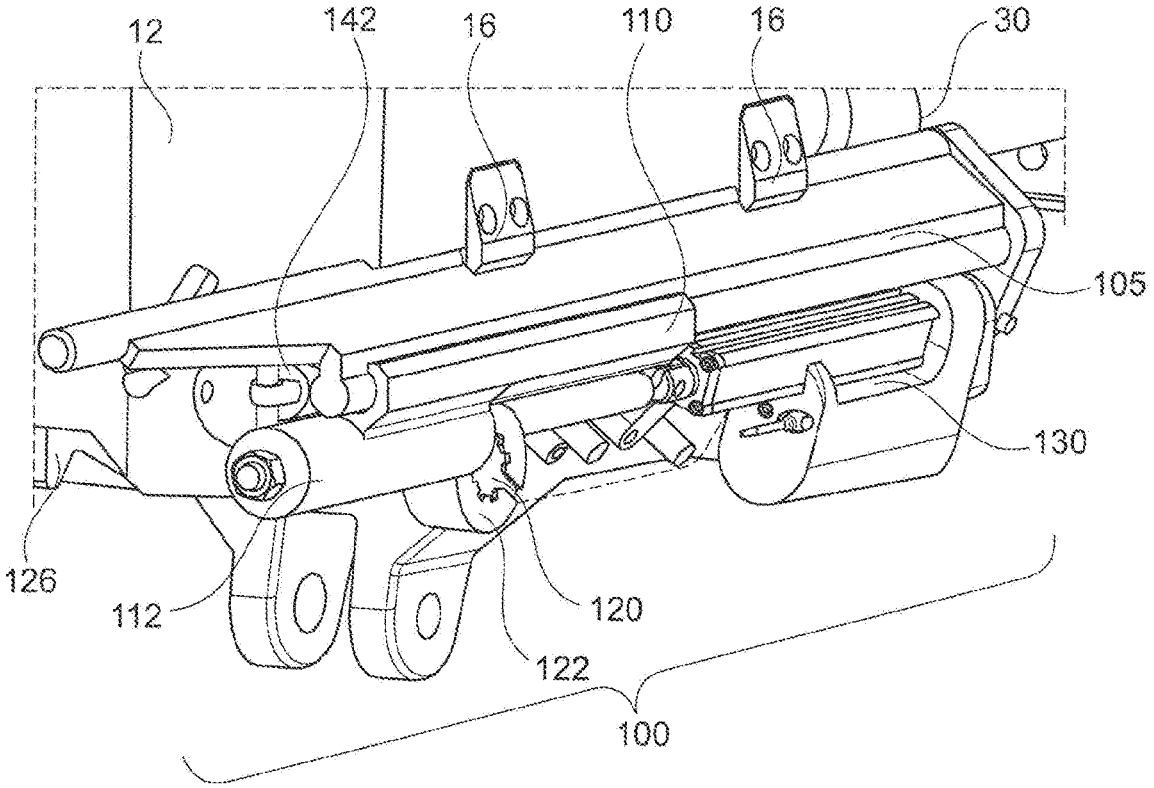
FIG. 2 shows a schematic perspective view of the breech mechanism of the breech system of the invention.

FIG. 2 shows a further enlarged schematic perspective view of breech mechanism 100 of breech system 10 of the invention according to the first embodiment. Base piece 12 comprises a bearing 16 in which guide piece 105, fixed to the cradle, is mounted so as to be axially movable.

Breech system 10 has a drive 130, which is designed in particular as a linear drive. Drive 130 is set up to realize an axial movement of actuating element 114 in its position relative to lever mechanism 150.

According to the first embodiment, guide element 110 is designed as a guide carriage 110 that is attached axially movable to guide element 110. Guide carriage 110 is mounted so as to be axially movable along guide piece 105.

Figure 3:
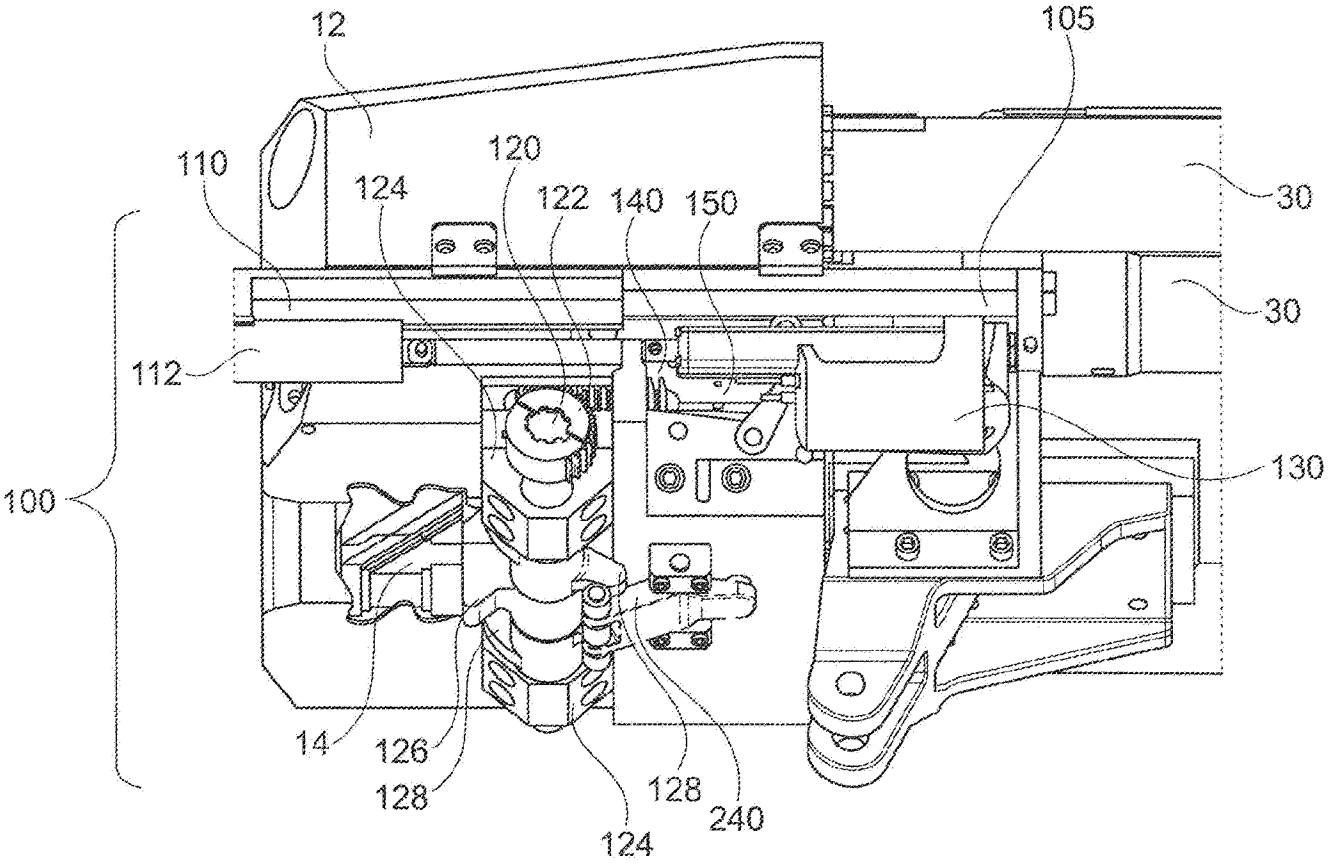
FIG. 3 shows a further schematic perspective view of the breech mechanism of the breech system of the invention.

FIG. 3 shows a further schematic perspective view of breech mechanism 100 of breech system 10 of the invention according to the first embodiment, wherein FIG. 3 shows the bottom side of breech system 10.

Breech mechanism 100 has an opener shaft 120 with a gear wheel 122, wherein gear wheel 122 is in engagement with a toothed rack 140 of breech mechanism 100. Opener shaft 120 is attached to the bottom side of base piece 12 via bearings 124 and has an opener lever 126. Opener shaft 120 can be driven via the gear wheel.

Opener shaft 120 has an opener lever 126 which interacts with breech wedge 14 such that breech wedge 14 can be moved between a closed and open position by opening lever 126. For this purpose, opener lever 126 is connected non-rotatably to opener shaft 120. In this case, FIG. 3 shows breech wedge 14 in the closed position. For opening, breech wedge 14 is brought downward from this closed position into its open position.

Toothed rack 140 is connected to a wedge closing spring 142 disposed in toothed rack 140. In the open position, breech wedge 14 can be pretensioned from the open position in the direction of its closed position by wedge closing spring 142.

Breech system 10 further has an ejector system 200 for extracting cartridge cases or cartridge bases from breech system 10. Ejector system 200 includes at least one ejector 232 and at least one ejector lever 234 that actuates ejector 232.

Ejector lever 234 is rotatably mounted on opener shaft 120 and ejector system 200 has at least one transmission element 240 which transmits a rotational movement of opener lever 126 to ejector lever 234.

Transmission element 240 is mounted on a first axle 243 which is spaced apart from opener shaft 120. First axle 243 is attached to the bottom side of base piece 12 with corresponding bearings, which support axle 243.

At least one first contact roller for contact with opener lever 126 is disposed at one end 241*a* of transmission element 240. Further, at least one second contact roller 244 is disposed at first end 241*a* of transmission element 240 for contact with the at least one ejector lever 234.

The at least one first contact roller and the at least one second contact roller 244 are disposed on a common second axle 246.

Ejector system 230 has at least one pretensioning element 250 that pretensions transmission element 240 with respect to the at least one ejector lever 234. According to the embodiment, pretensioning element 250 is a spring disposed at a second end 241*b* of transmission element 240.

Transmission element 240 is formed in the shape of a lever. The first end 241*a* has two fork-like projections on which axle 246 is disposed. The second end 241*b* is disposed on the opposite side of transmission element 240 and is angled away from first end 241*a*.

It can be seen in the figures that two ejector levers 234 are formed, for each of which a second contact roller 244 is formed.

Figure 4:
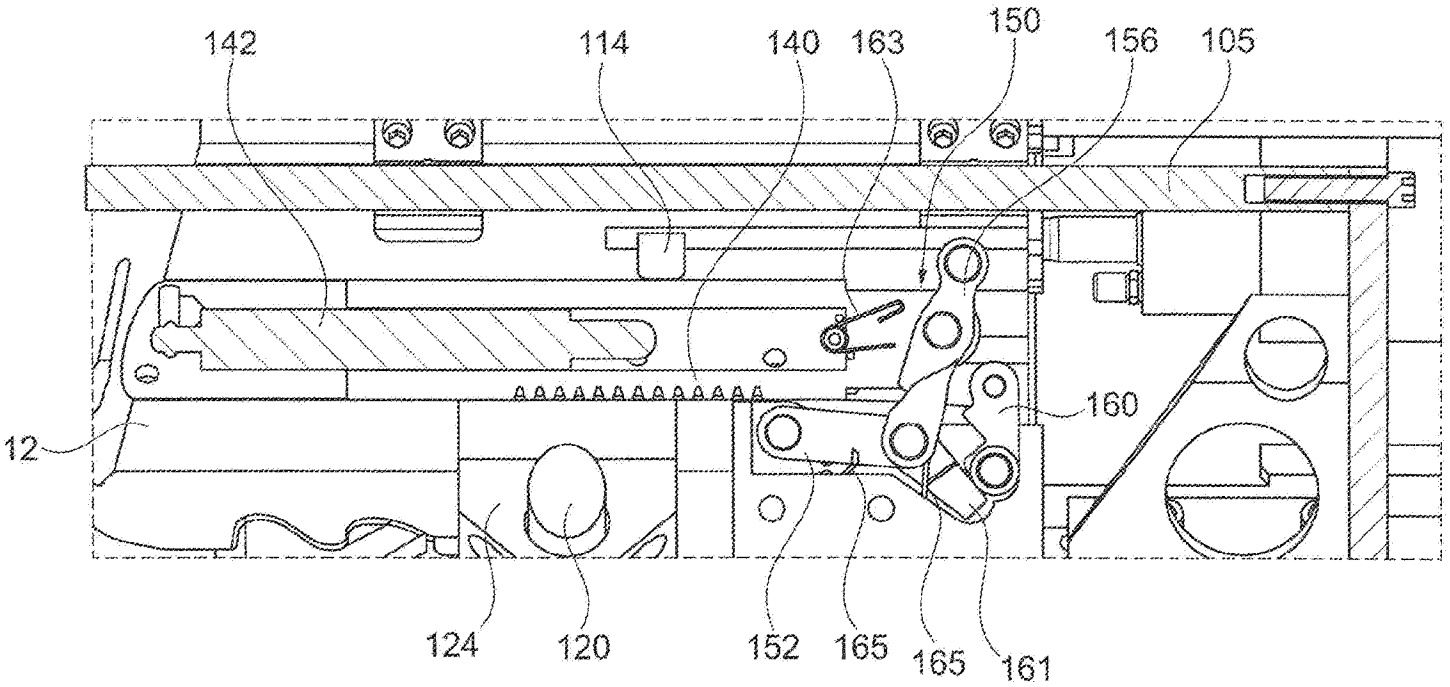
FIG. 4 shows a schematic sectional view of the breech mechanism of the breech system of the invention.

FIG. 4 shows a schematic sectional view of breech mechanism 100 of breech system 10 of the invention according to the first embodiment. According to FIG. 4, it can be seen that breech mechanism 100 has a toothed rack 140 and lever mechanism 150 comprises a toggle lever 151.

Toggle lever 151 has a coupler 152 and a lever 154. One end of lever 154 is coupled to toothed rack 140 and one end of lever 154 is coupled to locking lever 161 via a toggle joint 153 of toggle lever 151, as can be seen from FIGS. 4 to 6, for example.

Figure 5:
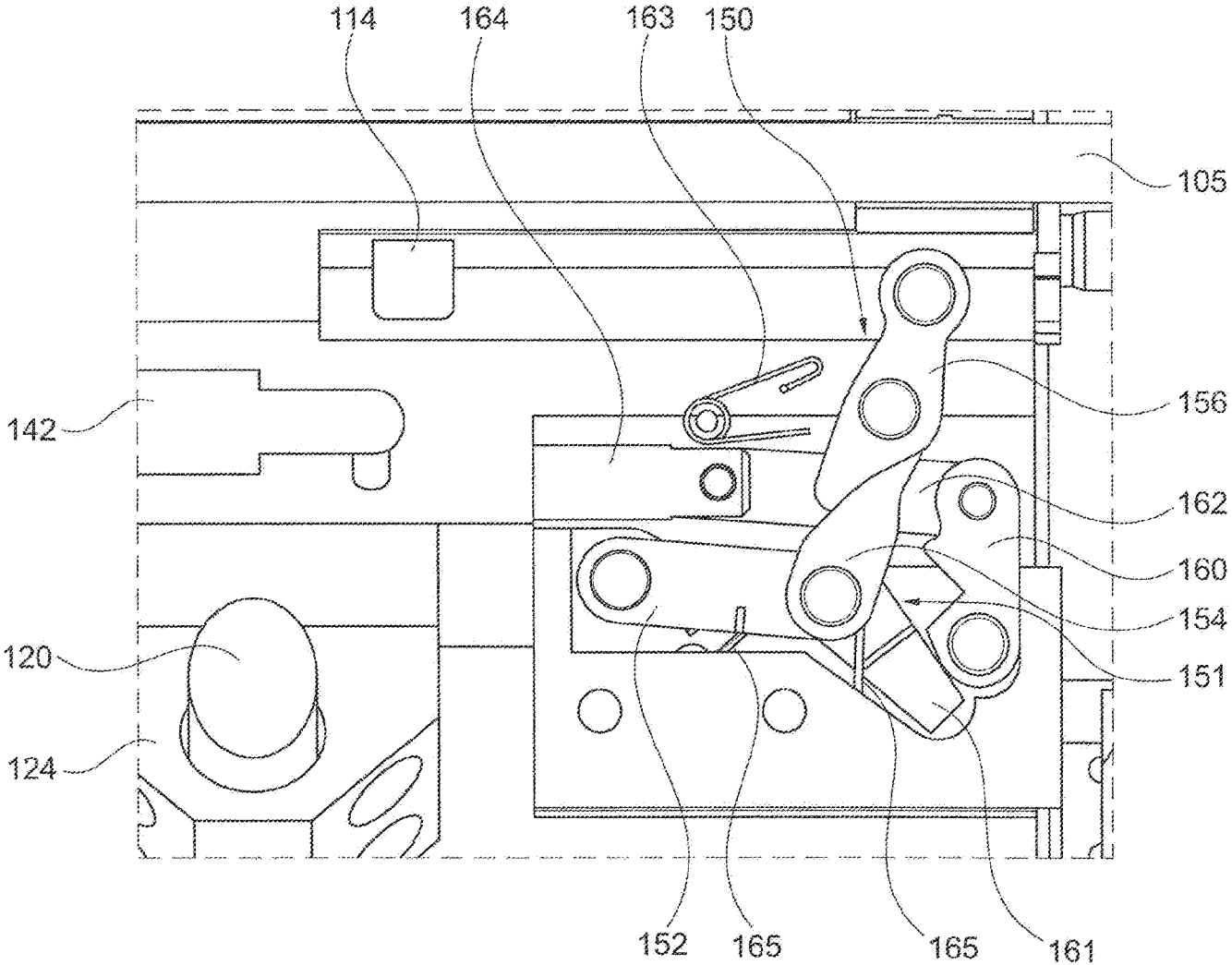
FIG. 5 shows a further schematic sectional view of the breech mechanism of the breech system of the invention.

FIG. 5 shows a further schematic sectional view of breech mechanism 100 of the breech system 10 of the invention according to the first embodiment.

Breech mechanism 100 has a detent pawl 160 that interacts with locking lever 161. Detent pawl 160 can be unlocked by locking lever 161 via an unlocking mechanism 162 coupled to detent pawl 160.

Figure 6:
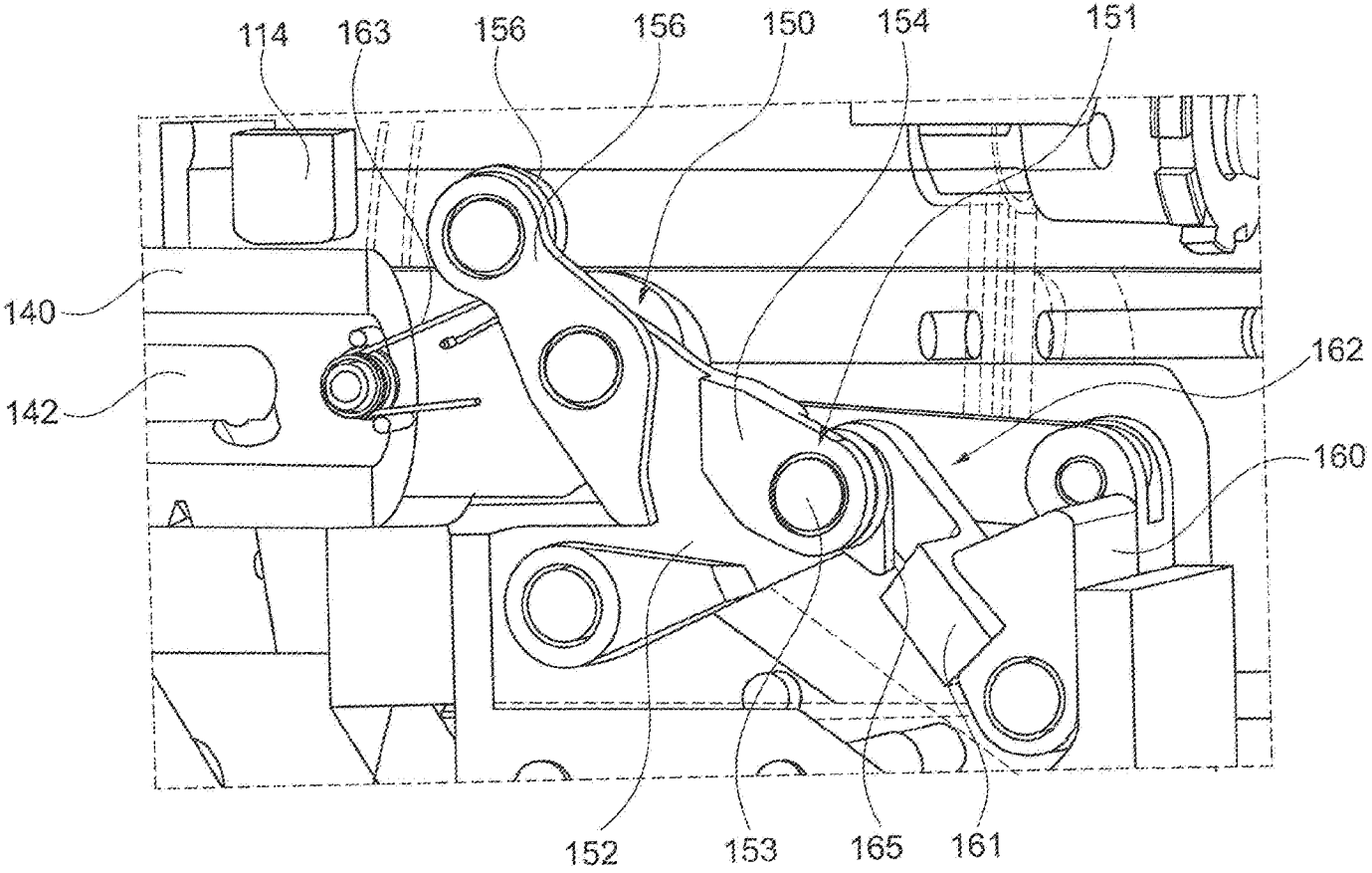
FIG. 6 shows a further schematic perspective view of the breech mechanism of the breech system of the invention.

FIG. 6 shows a further schematic perspective view of breech mechanism 100 of breech system 10 of the invention according to the first embodiment. It can be seen from FIG. 6 that lever mechanism 150 comprises a folding lever 156. Lever mechanism 150 can be actuated by actuating element 114 via folding lever 156 in an actuation direction. Folding lever 156 can be folded away in a direction opposite to the actuation direction.

It is shown in FIGS. 4 to 6 that actuating element 114 is designed such that it interacts with lever mechanism 150 when barrelled weapon 1 advances such that breech wedge 14 can be moved between the closed and open position by it, in particular in operative connection with at least toothed rack 140, gear wheel 122, opener shaft 122, and opener lever 126.

Figure 7:
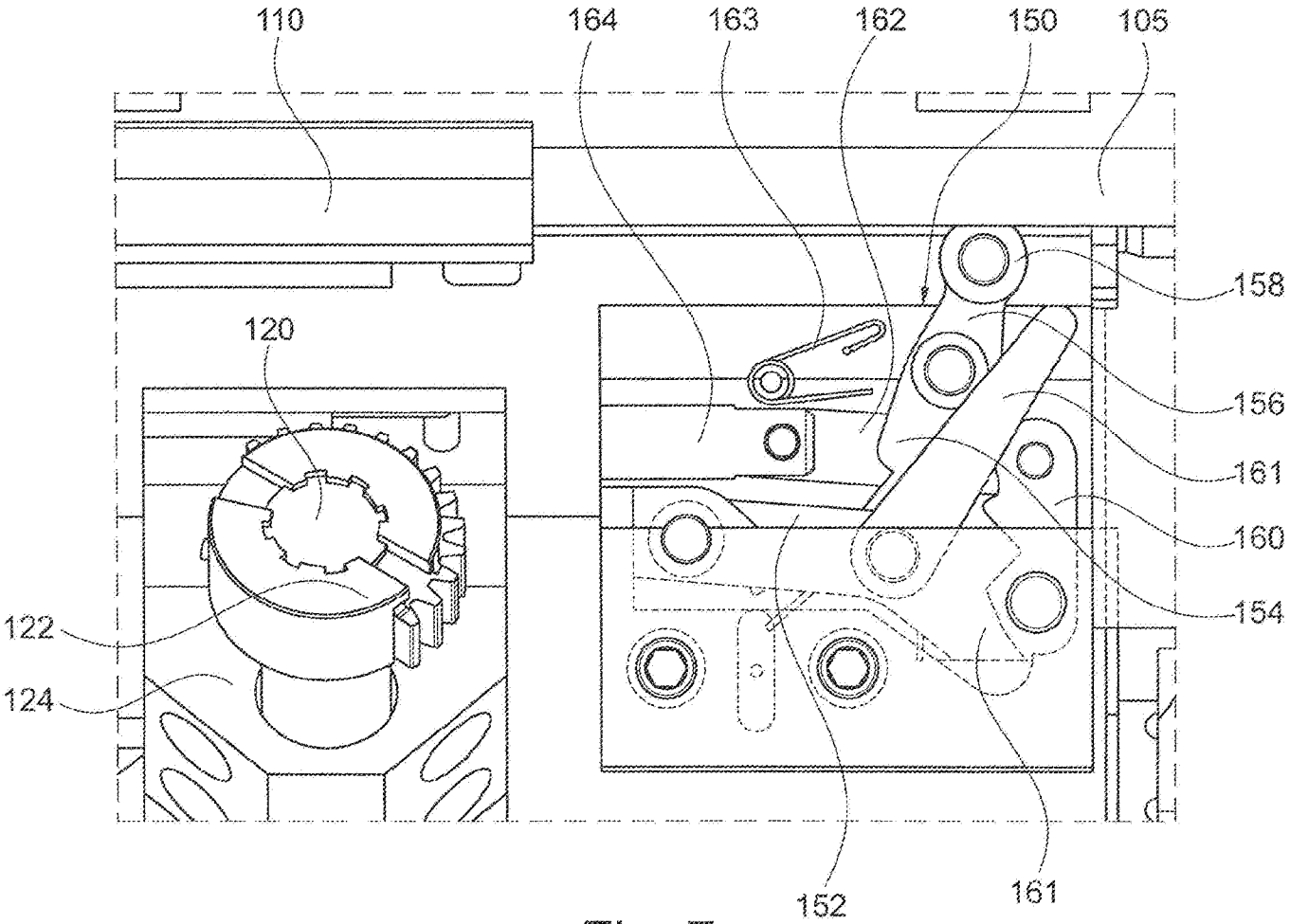
FIG. 7 shows a further schematic sectional view of the breech mechanism of the breech system of the invention.

FIG. 7 shows a further schematic sectional view of breech mechanism 100 of breech system 10 of the invention according to the first embodiment.

Figure 8:
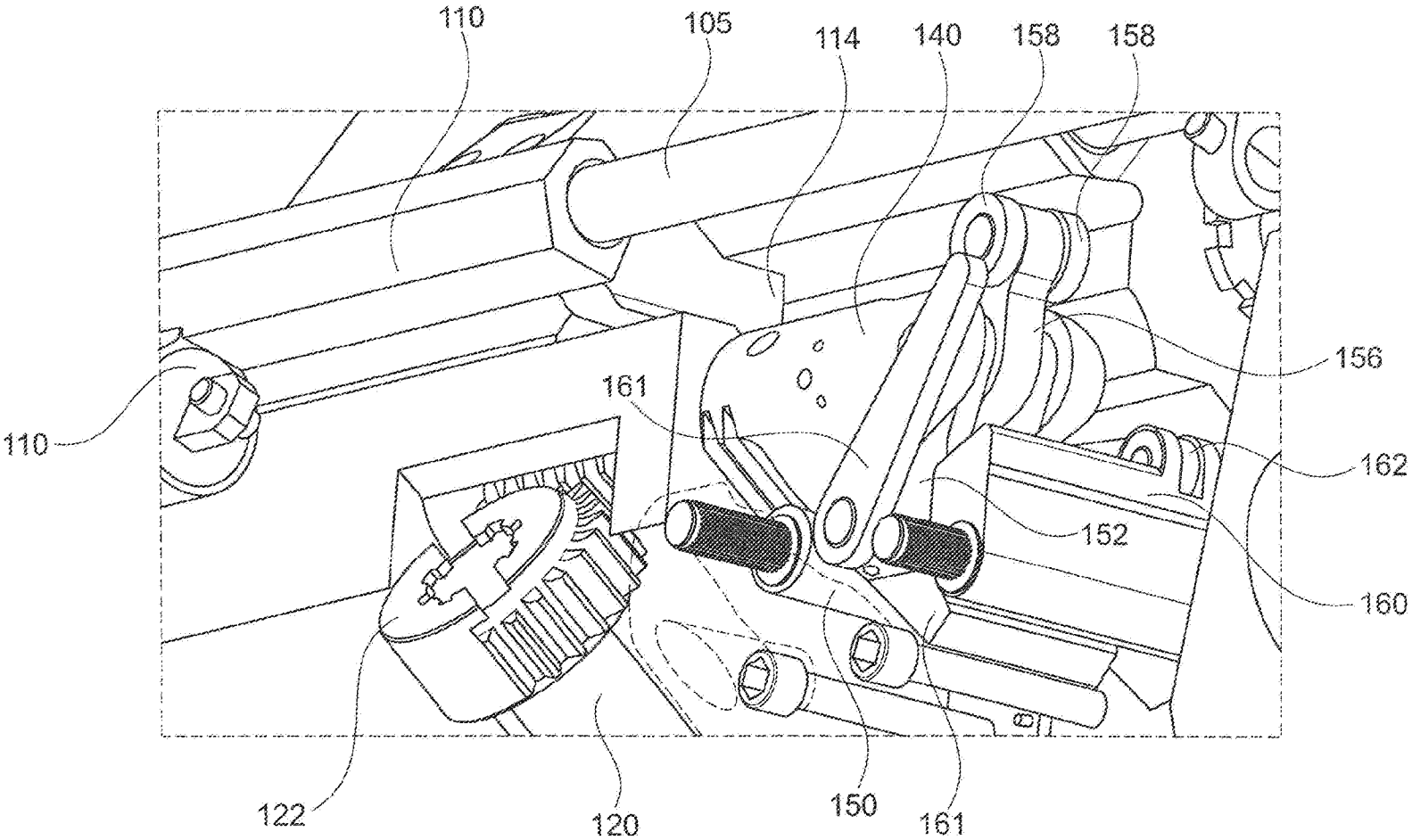
FIG. 8 shows a further schematic perspective view of the breech mechanism of the breech system of the invention.

FIG. 8 shows a further schematic perspective view of breech mechanism 100 of breech system 10 of the invention according to the first embodiment.

Figure 9:
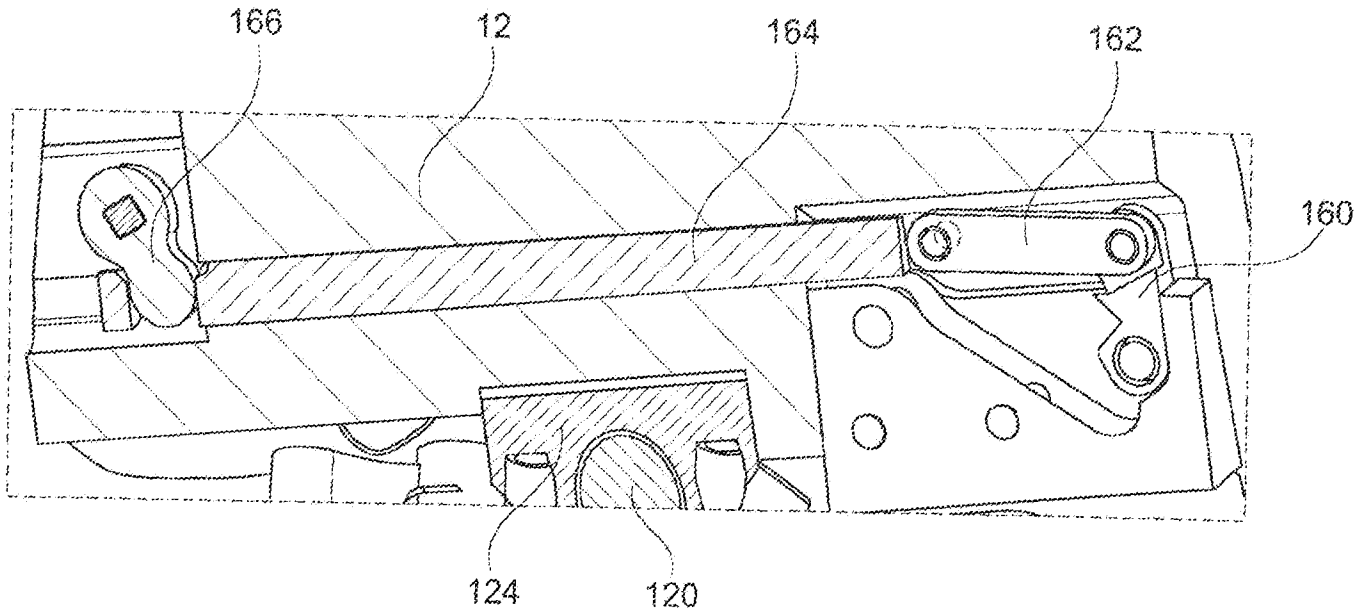
FIG. 9 shows a further schematic sectional view of the breech mechanism of the breech system of the invention.

FIG. 9 shows further a schematic sectional view of the breech mechanism of breech system 10 of the invention according to the first embodiment, wherein the part of base piece 12 is shown in section, said part which connects detent pawl 160 by unlocking mechanism 162 and a connecting element 164 to the rear region of base piece 12 in which base piece opening 13 is located.

Figure 10A:
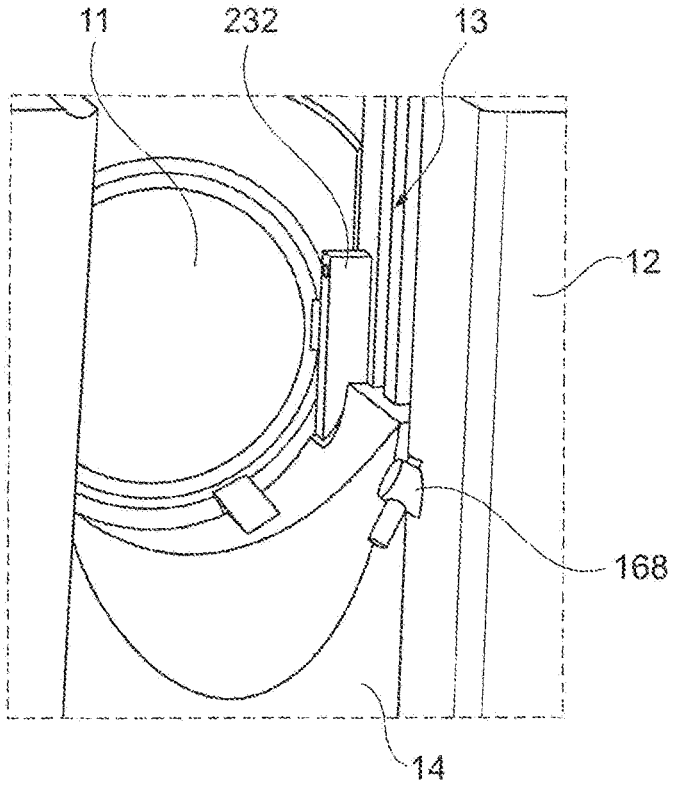
FIG. 10*a* shows a schematic perspective view of the base piece opening with the breech wedge in the open position.
Figure 10B:
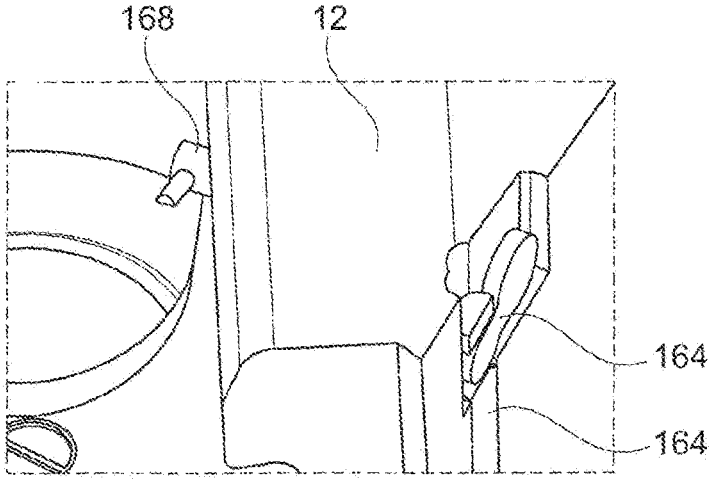
FIG. 10*b* shows a further schematic perspective view of the base piece opening with the breech wedge in the open position.

FIGS. 10*a* and 10*b* each show a schematic perspective view of base piece opening 13 with breech wedge 14 in the open position with an open cartridge chamber 11. Breech wedge 14 is in the open position and ejector 232 is clearly visible. The view shown in FIG. 11*b* shows ejector 236 after a cartridge base or a cartridge case has been ejected. Unlocking mechanism 162 is connected to an unlocking cam 168 disposed in base piece opening 13.

Figure 11A:
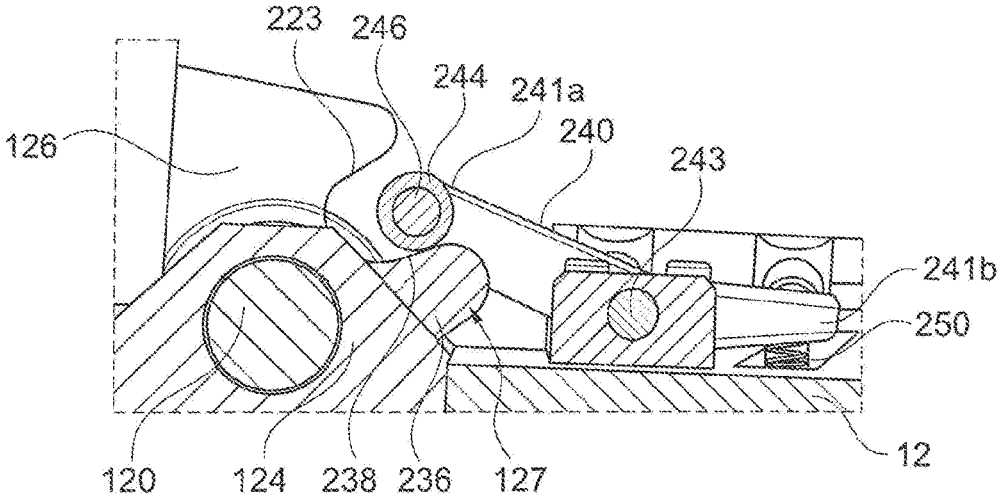
FIG. 11*a* shows a schematic side view of the bottom side of the base piece, wherein the breech wedge is in the closed position.
Figure 11B:
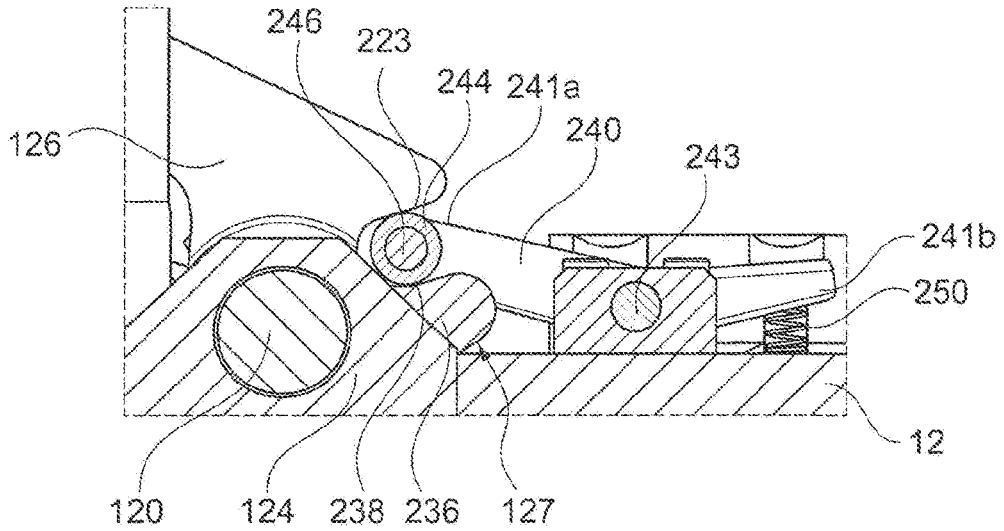
FIG. 11*b* shows schematic side view of the bottom side of the base piece, wherein the breech wedge is in the open position.

FIG. 11*a* shows a schematic side view of ejector system 200 of breech system 10 of the invention, wherein breech wedge 14 is in the closed position. FIG. 11*b* shows a schematic side view of ejector system 200 of breech system 10 of the invention according to FIG. 11*a*, wherein breech wedge 14 is in the open position.

The at least one ejector lever 127 has a first lever arm 236 with an arc-shaped contact surface 238 which is permanently in contact with the at least one second contact roller 244.

Furthermore, ejector lever 127 has a second lever arm. The second lever arm is used to actuate ejector 127.

Contact surface 238 of first lever arm 236 is formed substantially concave, so that the angle of rotation of the rotary movement of ejector lever 127 with respect to the angle of rotation of the rotary movement of opening lever 126 describes a progressive characteristic during opening of breech system 10.

Opener lever 126 is designed such that, in the open position of breech system 10, it is not in contact with the first contact roller and the first contact roller can be brought into contact with opener lever 126 in the course of the opening process.

As can be seen in FIGS. 11*a* and 11*b*, opener lever 126 has a projection with a contact surface 223 which can be brought into contact with the first contact roller. Contact surface 223 of opener lever 126 is substantially flat.

Figure 12:
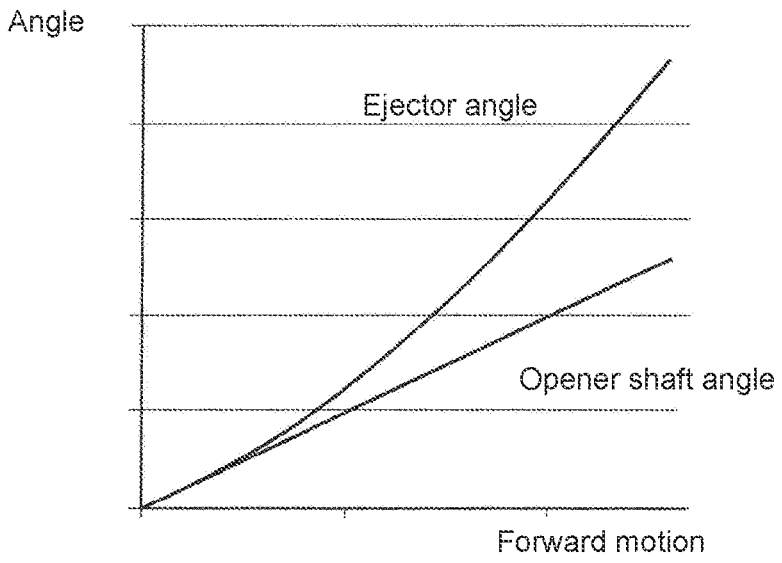
FIG. 12 shows a schematic diagram of the angle of the opener lever and the angle of the ejector lever with regard to the forward motion.

FIG. 12 shows a schematic diagram of the angle of rotation of opener lever 126 and the angle of rotation of ejector lever 127 with regard to the forward motion. The diagram shows that the angle of rotation of opener shaft 120 changes linearly with regard to the forward movement and the angle of rotation of ejector 232 describes a progressive characteristic.

Figure 13:
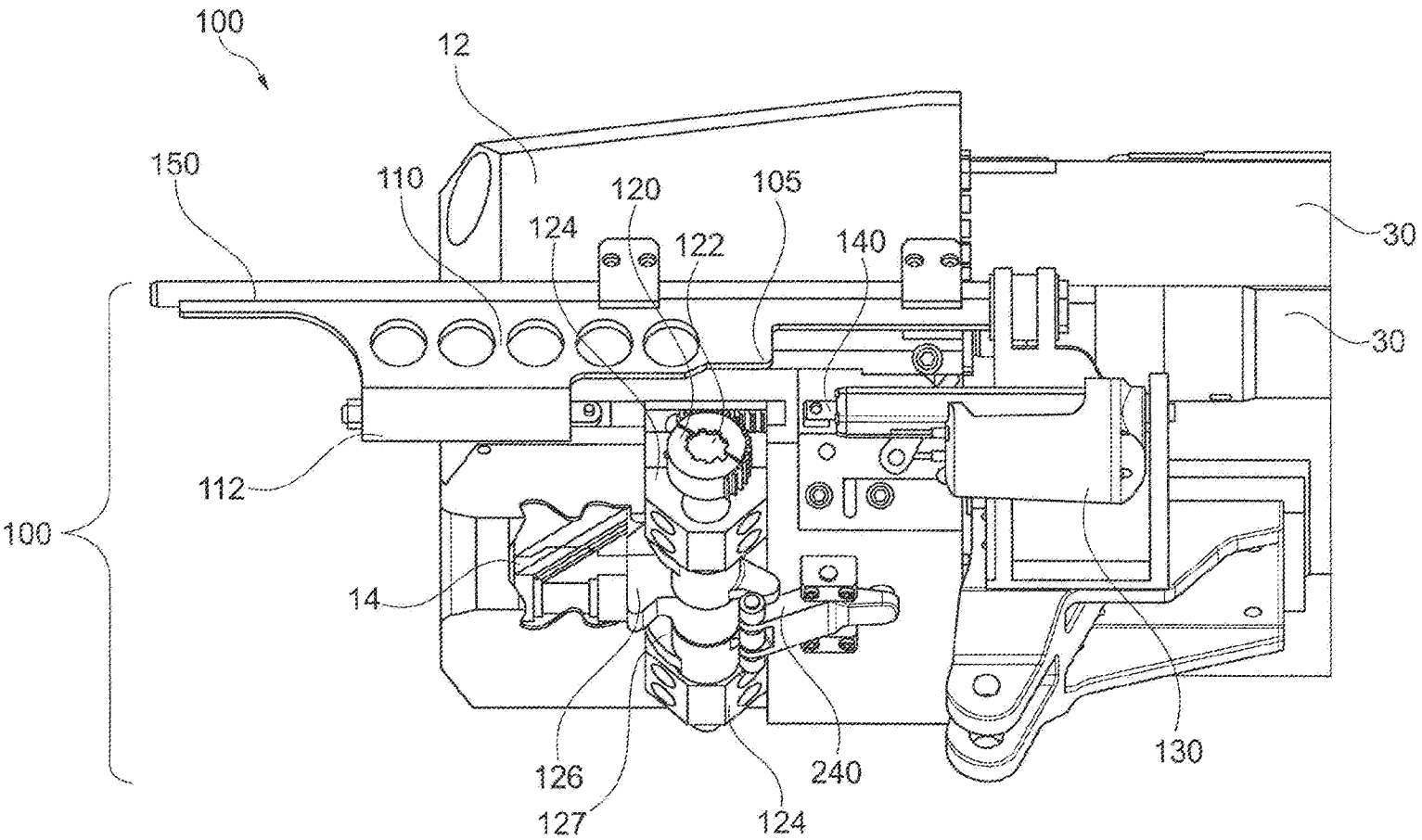
FIG. 13 shows a schematic perspective view of the breech mechanism of the breech system of the invention according to a second embodiment.

FIG. 13 shows a schematic perspective view of breech mechanism 100 of breech system 10 of the invention according to a second embodiment. According to the second embodiment of the invention, the guide element is formed as a guide profile 110'. Guide profile 110' directly comprises actuating element 114. Guide profile 110' is mounted movable directly on base piece 12 and movable on the cradle barrel.

Figure 14:
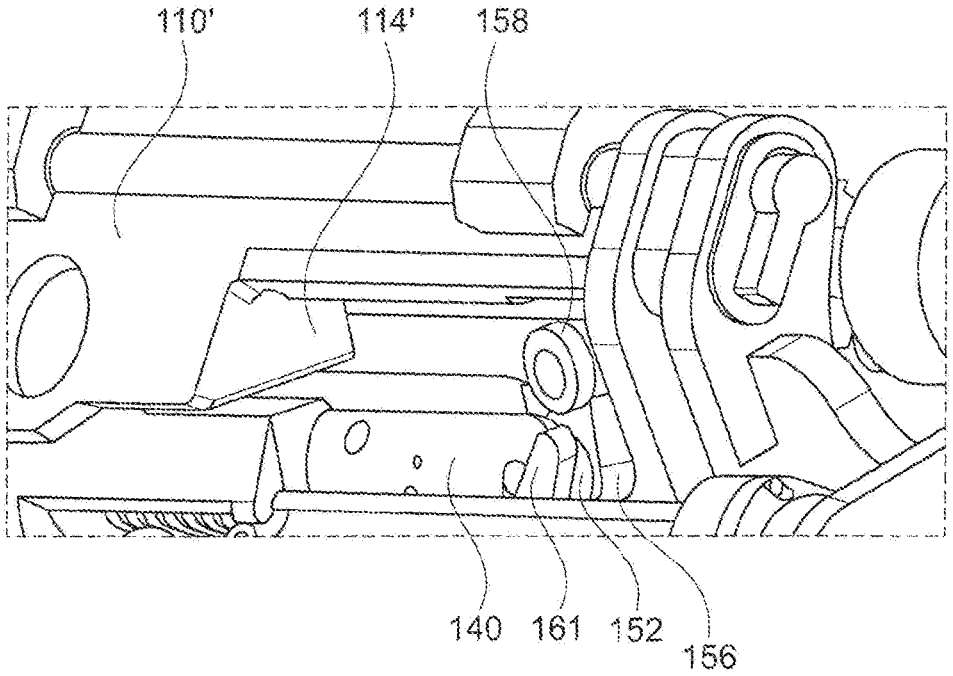
FIG. 14 shows a further schematic perspective view of the breech mechanism of the breech system of the invention according to a second embodiment.

FIG. 14 shows a further schematic perspective view of breech mechanism 100 of breech system 10 of the invention according to a second embodiment. As shown in FIG. 14, actuating element 114 is part of guide profile 110'. The actuating element in this case is designed as a projection extending downward from the guide profile.

The actuation can be done by the linear drive, fixed to the cradle, on the downwardly extending projection.

Further, a force-limiting spring element is disclosed.

The invention being thus described, it will be obvious that the same may be varied in many ways. Such variations are not to be regarded as a departure from the spirit and scope of the invention, and all such modifications as would be obvious to one skilled in the art are to be included within the scope of the following claims.

What is claimed is:

1. A breech system for a weapon barrel mounted in a cradle, the breech system comprising:

a base piece comprising a breech wedge movable between a closed position and an open position;

a breech mechanism attached to the base piece; and a guide piece fixed to the cradle and that has a guide element, the guide element has an actuating element for actuating the breech mechanism, wherein the breech mechanism has a lever mechanism that is actuated by the actuating element, wherein the breech mechanism has a locking lever coupled to the lever mechanism, wherein the breech wedge is locked in the open position by the locking lever, and wherein the breech mechanism has a toothed rack and the lever mechanism comprises a toggle lever, wherein the toggle lever comprises a coupler, a lever, and a toggle joint, wherein a first end of the lever is coupled to the toothed rack and a second end of the lever is coupled to the locking lever via the toggle joint of the toggle lever.

2. The breech system according to claim 1, wherein the base piece comprises a bearing in which the guide piece, fixed to the cradle, is mounted so as to be axially movable.

3. The breech system according to claim 1, wherein the breech mechanism has an opener shaft with a gear wheel, wherein the gear wheel is in engagement with the toothed rack.

4. The breech system according to claim 3, wherein the opener shaft has an opener lever which interacts with the breech wedge such that the breech wedge is moved between the closed position and the open position by the opening lever.

5. The breech system according to claim 4, wherein the actuating element interacts with the lever mechanism when the barrelled weapon advances such that the breech wedge is moved between the closed position and the open position by the actuating element in operative interaction with at least the toothed rack, the gear wheel, the opener shaft, and the opener lever.

6. The breech system according to claim 1, wherein the toothed rack is connected to a wedge closing spring, which is disposed in the toothed rack and via which the breech wedge is pretensioned in the open position in a direction of the closed position.

7. The breech system according to claim 1, wherein the breech system has a linear drive, which is set up to realize an axial movement of the actuating element relative to the lever mechanism.

8. The breech system according to claim 1, wherein the guide element is designed as a guide carriage that is axially movable, wherein the guide carriage is mounted to be axially movable along the guide piece.

9. The breech system according to claim 1, wherein the guide element is designed as a guide profile with the actuating element, wherein the guide profile is movably mounted directly on the base piece.

10. A barrelled weapon comprising a cradle, a weapon barrel mounted in the cradle, and at least one breech system according to claim 1.

11. A breech system for a weapon barrel mounted in a cradle, the breech system comprising:

a base piece comprising a breech wedge movable between a closed position and an open position;

a breech mechanism attached to the base piece; and a guide piece fixed to the cradle and that has a guide element, the guide element has an actuating element for actuating the breech mechanism, wherein the breech mechanism has a lever mechanism that is actuated by the actuating element, wherein the breech mechanism has a locking lever coupled to the lever mechanism, wherein the breech wedge is locked in the open position by the locking lever, and wherein the breech mechanism has a detent pawl which interacts with the locking lever and is unlocked by the locking lever via an unlocking mechanism coupled to the detent pawl.

12. The breech system according to claim 11, wherein the unlocking mechanism is connected to an unlocking cam disposed in the base piece opening.

13. A barrelled weapon comprising a cradle, a weapon barrel mounted in the cradle, and at least one breech system according to claim 11.

14. A breech system for a weapon barrel mounted in a cradle, the breech system comprising:

a base piece comprising a breech wedge movable between a closed position and an open position;

a breech mechanism attached to the base piece; and a guide piece fixed to the cradle and that has a guide element, the guide element has an actuating element for actuating the breech mechanism, wherein the breech mechanism has a lever mechanism that is actuated by the actuating element, wherein the breech mechanism has a locking lever coupled to the lever mechanism, wherein the breech wedge is locked in the open position by the locking lever, and wherein the lever mechanism comprises a folding lever, wherein the lever mechanism is actuated in an actuation direction by the actuating element and the folding lever is folded away in a direction opposite to the actuation direction.

15. A barrelled weapon comprising a cradle, a weapon barrel mounted in the cradle, and at least one breech system according to claim 14.

* * * * *